US006460507B2

(12) United States Patent
Thieleke et al.

(10) Patent No.: US 6,460,507 B2
(45) Date of Patent: Oct. 8, 2002

(54) COMBUSTION-ENGINED TOOL

(75) Inventors: Joachim Thieleke, Wasserburg; Kaveh Towfighi, Sigmarszell, both of (DE); Iwan Wolf, Chur (CH)

(73) Assignee: Hilti Aktiengesellschaft, Schaan (LI)

( * ) Notice: Subject to any disclaimer, the term of this patent is extended or adjusted under 35 U.S.C. 154(b) by 4 days.

(21) Appl. No.: 09/741,291

(22) Filed: Dec. 19, 2000

(65) Prior Publication Data

US 2001/0006045 A1 Jul. 5, 2001

(30) Foreign Application Priority Data

Dec. 23, 1999 (DE) ..... 199 62 599

(51) Int. Cl.[7] ..... F02B 19/16; B25C 1/08

(52) U.S. Cl. ..... 123/260; 123/46 R; 227/10

(58) Field of Search ..... 123/260, 267, 123/268, 280, 283, 286, 46 R, 46 A, 46 H, 37, 38, 39; 227/10, 11

(56) References Cited

U.S. PATENT DOCUMENTS 5,181,495 A * 1/1993 Gschwend et al. ..... 123/46 SC

* cited by examiner

*Primary Examiner*—Gene Mancene
*Assistant Examiner*—Arnold Castro
(74) *Attorney, Agent, or Firm*—Sidley Austin Brown & Wood, LLP

(57) ABSTRACT

A portable, combustion-engined tool including a collapsible combustion chamber (1) having a movable separation plate (18) for dividing the combustion chamber (1), in an expanded position of the combustion chamber, in a fore-chamber section (21) and at least one further chamber section (22), a movable combustion chamber wall (14) arranged parallel to the separation plate (18) for limiting, together with the separation plate (18), the forechamber section, an ignition device (52) located in the forechamber section (21), and a collapse control device (19, 20, 33) for controlling movement of the separation plate (18) and the movable wall (14) after the combustion of the gas mixture in the combustion chamber.

5 Claims, 3 Drawing Sheets

COMBUSTION-ENGINED TOOL

BACKGROUND OF THE INVENTION

1. Field of the Invention

The present invention relates to a portable, combustion-engined tool, in particular, a setting tool including a collapsible combustion chamber divided by a separation plate in a forechamber section having an ignition device and at least one further chamber section, with the forechamber section being limited by a movable combustion chamber wall arranged parallel to the separation plate, and with the separation plate having a plurality of openings which communicates the forechamber section with the at least one further chamber section.

2. Description of the Prior Art

A portable, combustion-engined tool described above is disclosed in the German Publication No. 199 50 352.

After the ignition process has been initiated in order to combust a fuel gas mixture, which fills the combustion chamber, the locking of the movable combustion chamber wall is lifted, a spring force provides for movement of the movable wall in a direction toward the piston, which adjoins the combustion chamber, whereby the combustion chamber is freed from waste gases. With this, the separation plate also moves in the direction toward the piston and, after a while, the movable wall lies on the separation plate, with the separation plate lying practically on the piston. As a result, the volume of the combustion chamber becomes practically reduced to zero. During the movement of the movable wall and the separation plate toward the piston, the forechamber section is deaerated only through the openings in the separation plate. To this end, at least one of the through-openings of the separation plate should be aligned with an exhaust valve located opposite the separation plate. If this is not the case, and the movable wall and the separation plate start to move toward each other only after the volume of the main or further chamber section has been reduced to zero, deaeration or the reduction of volume of the forechamber section takes place very slowly. This requires that at least one of the through-openings of the separation is exactly aligned with the opposite exhaust valve in order to insure a more rapid deaeration of the forechamber section. Insuring such an alignment is a very tedious job.

Accordingly, an object of the present invention is to provide means which would insure a rapid deaeration of the forechamber section in a tool of the above-described type under any circumstances.

SUMMARY OF THE INVENTION

This and other objects of the present invention, which will become apparent hereinafter, are achieved by providing, in the combustion chamber, collapse control means for controlling the movement of the movable wall and the separation plate, after the combustion of the gas mixture in the combustion chamber, so that the forechamber section collapses first and only then, the further chamber section collapses. When the combustion chamber has only two chamber sections, the further chamber section is called a main chamber section.

With the collapse control means according to the present invention, even if for some reasons, the exhaust valve is not aligned with the associated opening, a complete collapse of the combustion chamber can still be effected as, initially, only the movable wall is displaced toward the separation plate to reduce the volume of the forechamber section With the displacement of the movable wall, the waste gas filling the forechamber section is expelled from the forechamber section through the openings in the separation plate into the further or main chamber section. Only after the volume of the forechamber section has been reduced to zero, the movable wall and the separation plate are displaced together in the direction toward the piston in order to reduce the volume of the main chamber section also to zero. With such controlled displacement, a complete deaeration and/or reduction of the volume of the entire combustion chamber is insured under all circumstances.

The collapse control means can be formed in different ways. Thus, the collapse control means can so preload the movable wall and the separation plate relative to each other that they first would be displaced toward each other and only then would be displaced together in a direction toward the piston. To this end, e.g., the central projection or lug of the separation plate can project through the movable wall, with a compression spring being arranged between the free end of the lug and the movable wall. The spring retains the separation plate in its position at the beginning of movement of the movable wall in a direction toward the piston. As a result, first, the volume of the forechamber section is reduced to zero and it is deaerated before the reduction of volume of the main chamber section begins.

The collapse control means for controlling the movement of the movable wall and the separation plate can also determine the friction between the movable wall and the combustion chamber, on one hand, and between the separation plate and the combustion chamber on the other hand. When, e.g., the movable wall, for reducing the volume of the forechamber section, is driven by outer adjusting means, high friction between the separation plate and the combustion chamber, e.g., can insure that the separation plate remains stationary until the movable wall abuts it. In this way likewise, first, the forechamber section collapses, and the collapse of the main chamber section follows the collapse of the forechamber section.

Further, the collapse control means can be formed as means for a pneumatic control of the movement of the movable wall and the separation plate. In this case, the movement control of the displacement of the movable wall and the separation plate can be programmed.

According to further advantageous embodiment of the present invention, the through-openings of the separation plate can be formed as check valves which provide for gas flow only from the forechamber section into the further or main chamber section.

For obtaining a high piston energy, the combustion, e.g., in the main chamber section, should take place as rapidly as possible. A return flow from the main chamber section into the forechamber section results in an early expansion which, in turn, leads to the cooling down of the flame formed in the main chamber section. The pressure in the main chamber, dependent on the size of the forechamber section, becomes reduced or increases very slowly. In addition, a portion of the fuel gas mixture is forced back into the forechamber section and bums there. This portion of the combustion takes place in a timedelayed manner and contributes little to the piston energy. Providing check valves in the separation plate in collapsible systems permits to increase the energy yield.

Providing check valves in the separation plate insures flow only in one direction, namely, from the forechamber section into the main chamber section. This means narrowing in the flow direction and feeding of the fresh air into the forechamber section. In this case also, the collapse of the chamber sections should be so controlled that the forechamber section collapses first. If this is not the case, and the main chamber section collapses first, the check valves would not be open any more after the collapse, and the deaeration of the forechamber would practically stop.

Further, the movable wall can also be provided with at least one check valve which enables flow only into the forechamber section. Through this check valve, the forechamber section can be filled with fresh air when the movable wall moves away from the separation wall and the chamber sections expand. Upon expansion of the main chamber section, the fresh air enters it through the check valves in the separation plate, with the fresh air thus filling the entire combustion chamber.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
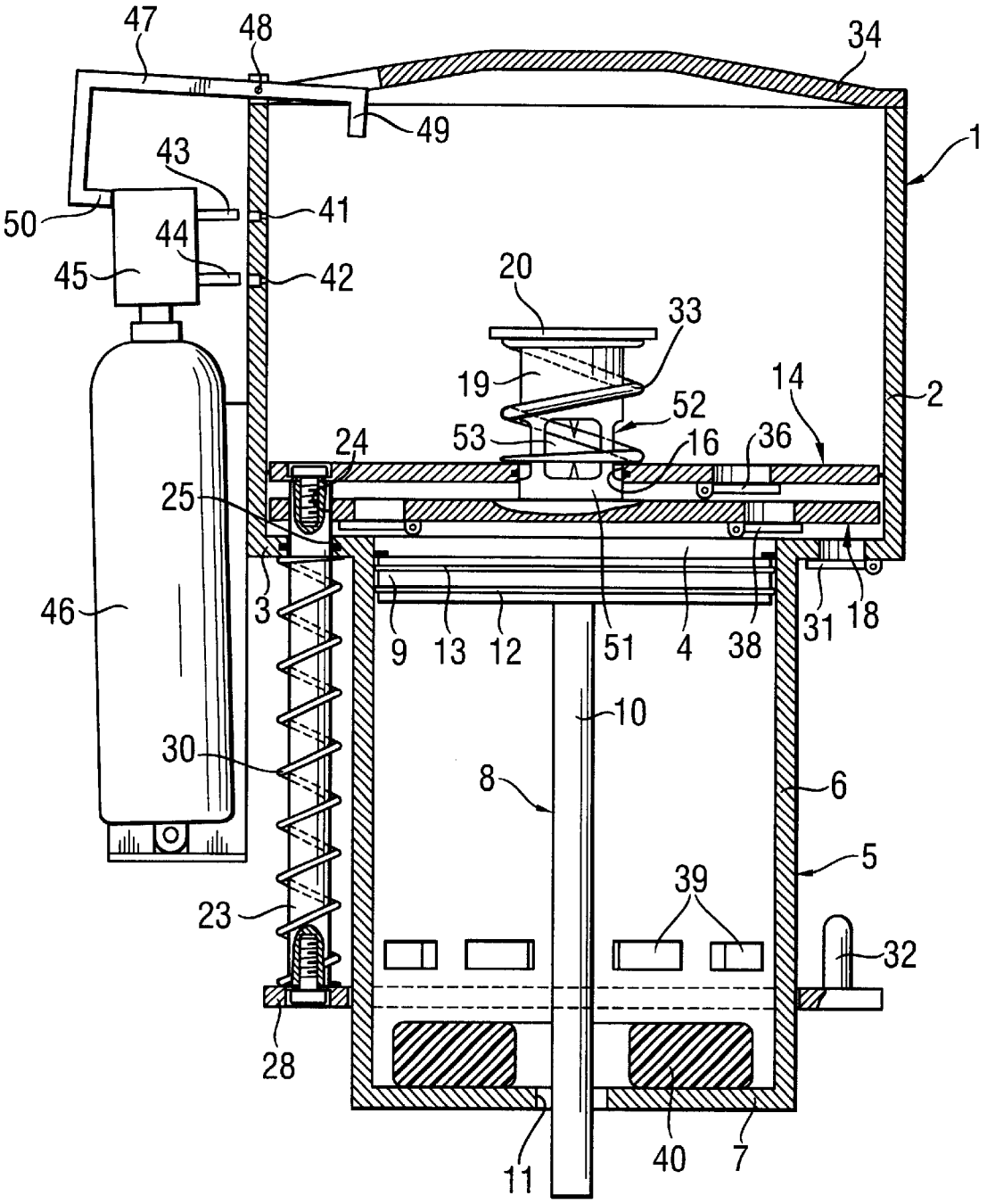
FIG. 1 shows an axial cross-sectional view of a combustion-engined tool according to the present invention with a completely collapsed combustion chamber.

FIG. 1 shows a cross-sectional view of the combustion-engined tool according to the present invention in the region of its combustion chamber. As shown in FIG. 1, a combustion chamber 1 of an inventive combustion-engined tool, in particular, of a setting tool, which is shown in FIG. 1, has a cylindrical shape and includes a cylindrical wall 2 and a ring-shaped bottom 3 adjoining the cylindrical wall 2. In the center of the bottom 3, there is provided an opening 4. A guide cylinder 5, which has a cylindrical wall 6 and a bottom 7, adjoins the opening 4 in the bottom 3 of the combustion chamber 1. A piston 8 is slidably displaceably arranged in the guide cylinder 5 for displacement in the longitudinal direction of the guide cylinder 5. The piston 8 consists of a piston plate 9 facing the combustion chamber 1 and a piston rod 10 extending from the center of the piston plate 9. The piston rod 10 projects through an opening 11 formed in the bottom 7 of the guide cylinder 5.

FIG. 1 shows a non-operational position of the setting tool in which the piston 8 is in its rearward off-position. The side of the piston plate 9 adjacent to the bottom 3 of the combustion chamber 1 is located closely adjacent to the bottom 3, with the piston rod 10 projecting only slightly beyond the bottom 7 of the guide cylinder 5. Sealing rings 12, 13, which can be provided on opposite sides of the piston plate 9 to seal the chambers on the opposite sides of the piston plate 9 from each other.

Inside of the combustion chamber 1, there is provided a cylindrical plate 14 further to be called a movable combustion chamber wall or movable wall. The plane of the plate 14 extends transverse to the longitudinal direction of the tool. The movable wall 14 is displaceable in the longitudinal direction of the combustion chamber 1. For separating the chambers on opposite sides of the movable wall 14, an annular sealing is provided on the circumference of the movable wall. The movable wall 14 has a central opening 16, with an annular seal provided in the wall forming the opening 16.

Between the movable wall 14 and the annular bottom 3 of the combustion chamber 1, there is provided a separation plate 18. The separation plate 18 likewise has a circular shape and an outer diameter corresponding to the inner diameter of the combustion chamber 1. The side of the separation plate 18 adjacent to the movable wall 14 is provided with a cylindrical lug 19 that projects through the central opening 16 in the movable wall 14 and the length of which exceeds the thickness of the movable wall 14 in several times. The seal provided in the opening 16 engages the outer circumference of the cylindrical lug 19. At its free end, the cylindrical lug 19 is provided with a shoulder 20 the outer diameter of which exceeds the inner diameter of the opening 16 in the movable wall 14.

Between the movable wall 14 and the annular shoulder 20, there is further provided a compression spring 33 which is supported, at its opposite ends, against the movable wall 14 and the shoulder 20 and which biases the separation plate 18 and the movable wall 14 toward each other. The compression spring 33 preloads the separation plate 18 and the movable wall 14 with respect to each other. The cylindrical lug 19 or, actually, the annular shoulder 20, in an end position in which the cylindrical lug 19 is spaced from the bottom 3 by a largest distance, abuts the end wall 34 of the housing of the combustion chamber 1.

When the movable wall 14 moves away from the bottom 3, it entrails, via the compression spring 33 and the shoulder 20, the separation plate 18. The movement of the separation plate 18 stops when the shoulder 20 abuts the wall 34. With the movable wall 14 moving further, the spring 33 is compressed. At the end of movement of both the movable wall 14 and the separation plate 18, a forechamber section 21 and a main chamber section 22 are formed between the separation plate 18 and the bottom 3.

For displacing the movable wall 14, there are provided several, e.g., three drive rods 23 uniformly distributed along the circumference of the movable wall 14 and fixedly connected therewith. Only one of the drive rods 23 is shown in FIG. 1. The drive rods 23 extend parallel to the axis of the combustion chamber 1 and outside of the cylindrical wall 6 of the guide cylinder 5. The drive rods 23 extend through openings 24, respectively, formed in the separation plate 18 and through corresponding openings 25 formed in the bottom 3 of the combustion chamber 1. Each of the openings 25 is provided win a circumferential seal located in the surface defining the opening 25 for sealing the combustion chamber 1 from outside. The movable wall 14 is connected with drive rods 23 by, e.g., screws 27 which extend through the movable wall 14 and are screwed into the drive rods 23. The free ends of the drive rods 23 are connected with each other by a drive ring 28 which is arranged concentrically with the combustion chamber axis and which circumscribes the guide cylinder 5. The drive ring 28 is connected with the drive rods 23 by screws which extend through the drive ring 28 and are screwed into the drive rods 23 through end surfaces of the free ends of respective drive rods 23. Each of the drive rods 23 supports a compression spring 30 extending between the bottom 3 of the combustion chamber 1 and the drive ring 28. The compression springs 30 are designed to always bias the movable wall 14 toward the bottom 3.

In the region of the bottom 3, there is provided a check valve 31 which provides for flow only out from the combustion chamber 1. In order to close the check valve 31, i.e., to prevent gas flow from the combustion chamber 1 out, an actuation member 32 is provided on the drive ring 28. The actuation member 32 is arranged opposite the check valve 31. Upon displacement of the drive rods 23 in a direction in which the distance between the movable wall 14 and the bottom 3 increases, the actuation member 23 moves toward the check valve 31 and, in the position of the movable wall 14 in which the movable wall 14 is spaced from the bottom 3 by a largest possible distance, the actuation member 32 engages the check valve 31, preventing its opening.

The separation plate 18 has, along a concentric circle, a plurality of openings provided with check valves 38 arranged angularly equidistantly relative to each other. Because the check valves 38 are arranged along a concentric circle, they are also equidistantly spaced from the cylindrical axis of the combustion chamber 1. As it has already been discussed, the medium can flow through the check valves 31 only from the forechamber section 21 into the main chamber section 22. A flow in opposite direction is not possible.

At least one check valve 36 is provided in the movable wall 3. The check valve 36 provides for flow of air from outside into the forechamber section 21 but prevents flow in opposite direction.

Also, at the lower end of the guide cylinder 5, there is provided a plurality of outlet openings 39 for flow of air or waste gases out of the guide cylinder 5 when the piston 8 moves in a direction toward the bottom 7. At the lower end of the guide cylinder 5, there is provided damping means 40 for damping the movement of the piston 8. As soon as the piston 8 passes the openings 39, the waste gas can flow out through the openings 39.

The cylindrical wall 2 of the combustion chamber 1 has axially spaced from each other, radial openings, 41, 42. The openings 41, 42 communicates via feed channels 43, 44 with a metering head 45 provided with metering valves, not shown. A liquefied gas is delivered to the metering head 45 from a flask 46. The liquefied gas flows from the metering head 45 through the feed channels 43, 44 into the openings 41, 42 when the metering head 45 is pressed toward the cylindrical wall 2 of the combustion chamber 1, with the channels 43, 44 moving inward, opening respective valves. The cross-section of the radial openings 41, 42 is reduced in a direction toward the combustion chamber 1, with the respective transitional surfaces serving as stops for the feed channels 43, 44. The pressing of the metering head 45 toward the cylindrical wall 2 is effected with a stirrup 47 which is pivotally supported on the cylindrical wall 2 at a pivot point 48. The end 49 of the stirrup 47 is engaged by the movable wall 14 which lifts the end 49, pivoting the stirrup 47 in the counterclockwise direction about the pivot point 48. Upon pivotal movement of the stirrup 47, the other end 50 thereof presses the metering head 45 toward the cylindrical wall 2. This process starts shortly before the movable wall 14 reaches its end position when the forechamber 21 is completely expanded. The metering head 45 and the flask 46 form a unitary assembly and are permanently connected with each other. The system metering head 45-flask 46 can, e.g., be titled about an axle provided in the bottom region of the flask 46.

Figure 2:
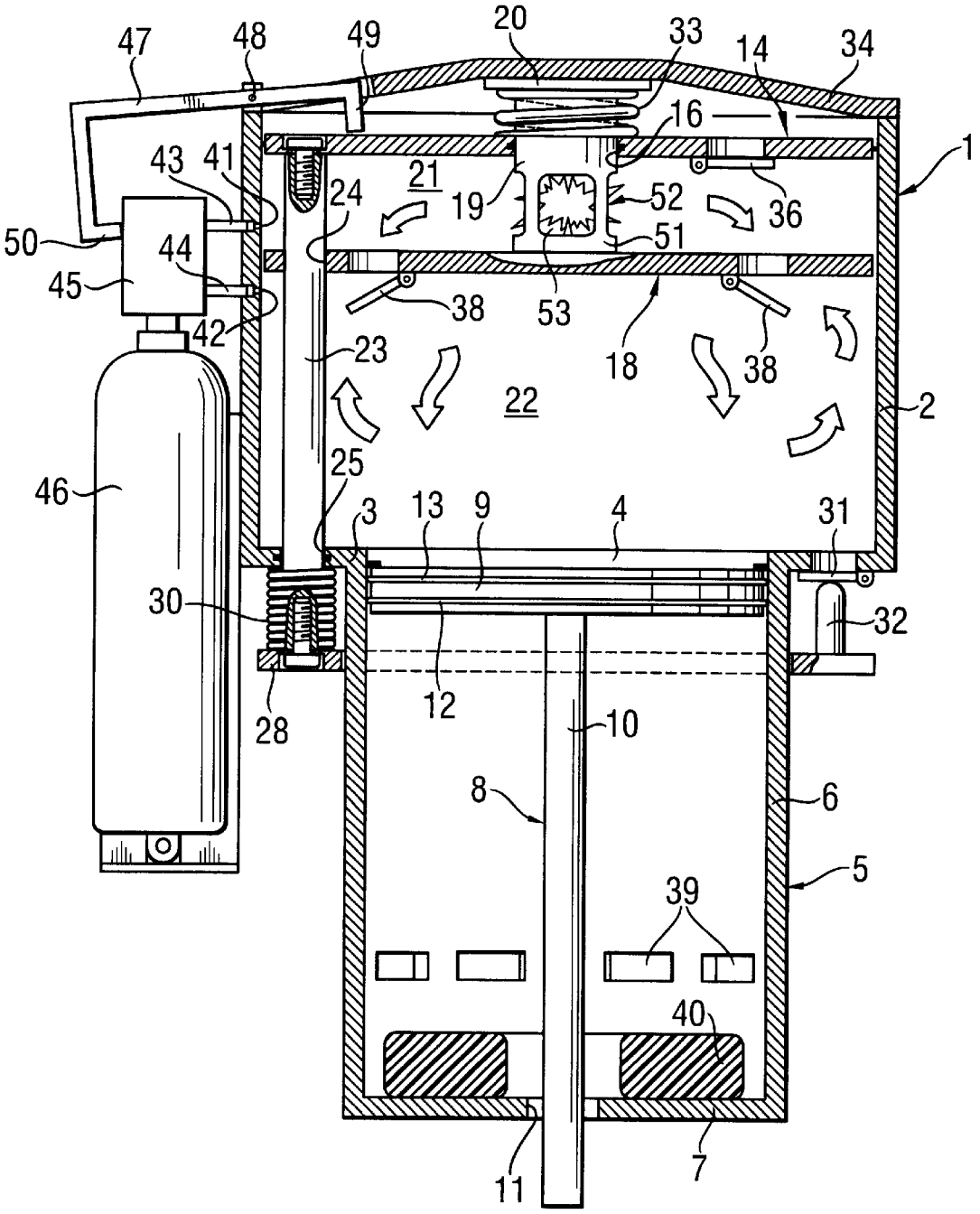
FIG. 2 shows a cross-sectional view of the tool shown in FIG. 1 with expander forechamber and main chamber sections.

FIG. 2 shows the tool in a position in which the forechamber section 21 and the main chamber section 22 are completely expanded. The respective end positions of the movable wall 14 and the separation plate 18, which correspond to a completely expanded condition of the forechamber section 21 and the main chamber section 22, are determined by respective stops. Thus, the check valve 31 can serve as a stop for the drive ring 28 the position of which determines the position of the movable wall 14. The check valve 31, as discussed above, is closed by the actuation member 32 mounted on the drive ring 28 and, when closed, the check valve 31 blocks further movement of the drive ring 28. The position of the separation plate 18, i.e., its distance from the movable wall 14 is determined, on one hand, by degree of compression of the spring 33, which pulls the separation wall 18 toward the movable wall 14 and, on the other hand, by engagement of the shoulder 20 of the lug 19 with the end wall 34. As shown in FIG. 2, the distance between the movable wall 14 and the separation plate 18, in the completely expanded condition of the forechamber section 21 and the main chamber section 22, is somewhat smaller than the length of the cylindrical lug 19.

In this position of the movable wall 14 and the separation plate 18, the radial openings 41, 42 open into the forechamber section 21 and the main chamber section 22, respectively.

At the end of the cylindrical lug 19 adjacent to the separation plate 18, there is provided a cage 51 in which an ignition device 52 is received. The ignition device 52 generates an electrical spark for igniting the fuel gas mixture in the forechamber section 21. The ignition device 52 is located in the central region of the cage 51 the circumference of which is provided with a plurality of openings 53 through which a laminar flame front exit from the cage 51 into the forechamber section 21.

Figure 3:
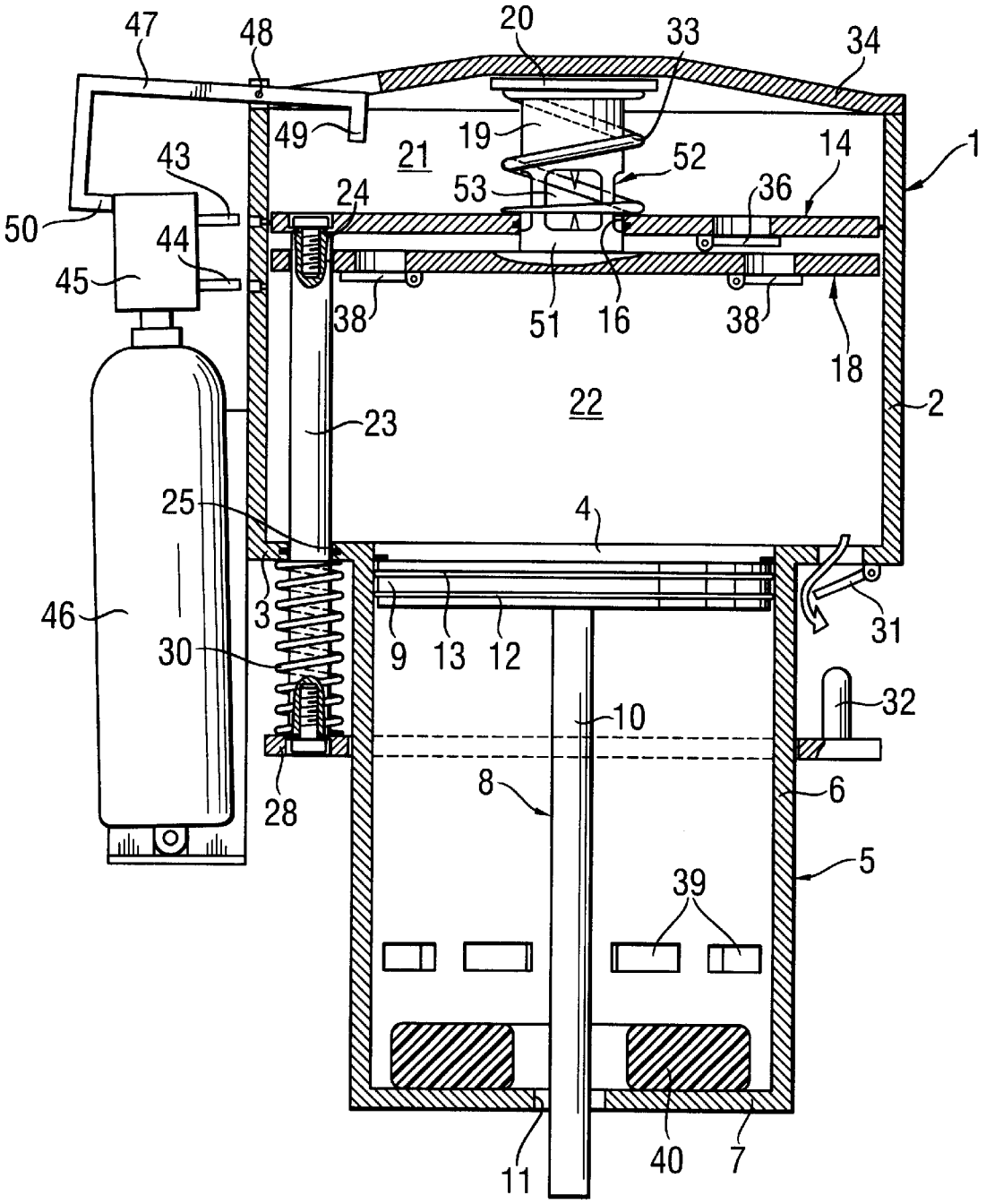
FIG. 3 shows a cross-sectional view of the tool shown in FIG. 2 after completion of the ignition process and a complete collapse of the forechamber section.

The operation of the setting tool will now be described in detail with reference to FIGS. 1, 2 and 3.

FIG. 1 shows the condition of the combustion chamber 1 in the off position of the setting tool. The combustion chamber I is completely collapsed, with the separation plate 18 lying on the bottom 3 of the combustion chamber 1 and the movable wall 14 lying on the separation plate 18. In order to distinguish the movable wall 14 from the separation plate 18, for the clarity sake, they are shown slightly separated. The piston 8 is in its rearward off position, so that practically no space remains between the piston 8 and the separation plate 18 if one would disregard a small clearance therebetween. The position, in which the movable wall 14 lies on the separation plate 18, results from the compressing spring 30 biasing the drive ring 28 away from the bottom 3, with the ring 28 pulling the movable wall 14 via the drive rods 23, toward the separation plate 18. The movable wall 14 pushes the separation plate 18 toward the bottom 3 so that all of the movable wall 14, the separation plate 18, and the bottom 3 lie on each other. In this position, the actuation member 32 is spaced from the check valve 31 which, however, remains closed.

The check valve 31 can actually remain open in the operating (setting) direction of the tool, however, no overpressure is generated in the combustion chamber 1. The check valves 36, 38 also remain closed. The system metering head 45—flasc 46 is spaced from the combustion chamber 1, with the channels 43, 44 occupying their rearward position so that respective metering valves remain closed also.

When in this condition, the setting tool is pressed with its front point against an object, the fastening element should be driven in, a mechanism, not shown, applies pressure to the drive ring 28 displacing it in the direction of the bottom 3 of the combustion chamber 1. This takes place simultaneously with the setting tool being pressed against the object. Upon displacement of the drive ring 28 toward the bottom 3, the movable wall 14 is lifted of the separation plate 18, in effect, dependent on the strength of the compression spring 33. After a while, the movable wall 14 entrains, via the spring 33, the separation plate 18. Finally, the cylindrical lug 19 abuts the end wall 34, and the separation plate 18 occupies its end position. The main chamber section 22 becomes completely expanded. The movable wall 14 continues to move further, compressing the spring 33, with the forechamber 21 being completely expanded when the spring 33 becomes completely compressed.

During the expansion of the forechamber section 21 and the main chamber section 22, the air penetrates into the chamber sections 21, 22 through check valves 36, 38, respectively, which open upon the movable wall 14 and the separation plate 18 moving in the direction toward the end wall 34.

With the tool being further pressed against the object, the drive ring 28 moves further in a direction toward the bottom 3. In a short while, the upper surface of the movable plate 14 engages the end 49 of the stirrup 47, pivoting the stirrup 47 counterclockwise about the pivot point 48. The other end 50 of the stirrup 47 pushes the metering head 45 in the direction toward the cylindrical wall 2, with the feed channels 43, 44 being pressed inward of the metering head 45 and opening, thereby, the respective metering valves. A metered amount of the liquefied fuel gas is injected into the forechamber section 21 and the main chamber section 22. It is possible to further lift the movable wall 14 somewhat until it reaches its position in which the forechamber is completely expanded, and the spring 33 is completely compressed.

The further pivotal movement of the stirrup 47 is compensated by a further movement of the feed channels 43, 44 into the metering head 45.

In the last stage of movement of the movable wall 14 toward the end wall 34, the check valve 31 is engaged by the actuation member 32 which prevents the check valve 31 from opening.

In the completely expanded position of the forechamber and main chamber sections 21, 22 which is shown in FIG. 2, the movable wall 14 and the separation plate 18 are locked. This is effected by actuating a respective lever or trigger which, e.g., locks the drive ring 28. Shortly thereafter, an ignition spark is generated by the ignition device 52. A fuel mixture, which was previously formed in the chamber sections 21, 22, e.g., an air-fuel gas mixture, starts to burn laminary in the forechamber section 21, with a flame front propagating radially, with a comparatively slow speed, in a direction toward the check valves 38. The flame front displaces the unconsumed air-fuel gas mixture ahead of it. The mixture enters through the check valves 38 into the main chamber section, creating there turbulence and pre-compression. The mixture cannot exit the forechamber section 21 through the check valve 36.

As the flame front reaches the check valves 38, the flame penetrates therethrough, due to the small cross-section of the check valves 38, in a form of flame jets into the main chamber section 22, creating there a further turbulence. The thoroughly intermixed air-fuel gas mixture in the main chamber section 22 ignites over the entire surface of the flame jets. The mixture bums with a high speed which substantially increases the effect of combustion.

The combustible mixture in the main chamber section impacts the piston 8, which moves with a high speed toward the bottom 7 of the guide cylinder 5, forcing the air from the guide cylinder 5 out through the openings 39. Upon the piston plate 9 passing the openings 39, the exhaust gas is discharged therethrough. The piston rod 10 effects setting of a fastening element.

After setting or following the combustion of the air-fuel mixture, the piston 8 is brought to its initial position, which is shown in FIG. 2, as a result of thermal feedback produced by cooling of the fuel gases which remain in the combustion chamber 1 and the guide cylinder 5. As a result of cooling of the fuel gases, an underpressure is created behind the piston 8 which provides for return of the piston 8 to its initial position. The combustion chamber 1 should remain sealed until piston 8 reaches its initial position. In its initial position, the piston 8 can be retained, e.g., with magnetic means or the like.

After it is insured that the piston 8 reached its initial position, which is shown in FIG. 1, again, the movable wall 14 and/or the drive ring 28 is (are) unlocked. The compression springs 30 bias the drive ring 28 in a direction away from the bottom 3 of the combustion chamber 1. The actuation member 32, which is mounted on the drive ring 28, releases the check valve 31. Upon displacement of the drive ring 28 away from the bottom 3 under the action of springs 30, the drive rods 23 pull the movable wall 14 in the direction toward the bottom 3, as shown in FIG. 3. At this movement of the movable wall 14, the separation plate 18 remains stationary as the compression spring 33, which is supported on the movable wall 14, biases the separation plate 18 toward the end wall 34 (via the shoulder 20 of the lug 19 connected with the separation plate 14). This results in that the movable wall 14 moves toward the still stationary separation plate 18, whereby the forechamber section 21 collapses, with the main chamber section 22, remaining in the expanded condition. The exhaust or waste gases can leave the forechamber section 21 through the check valve 38 and enter the main chamber section 22 and therefrom outside through the open check valve 31. Finally, the movable wall 14 lies on the separation plate 18. After the movable wall 14 lies on the separation plate 18, both move toward the bottom 3, with the exhaust gases exiting from the main chamber section 22 out through the check valve 31. The movement of the movable wall 14 and the separation plate 1.8 continues until the position shown in FIG. 1 is reached. The combustion chamber 1 is completely collapsed, and an aeration process can begin anew upon a next setting of the fastening element.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A portable, combustion-engined tool, comprising a collapsible combustion chamber (1); a movable separation plate (18) located in the combustion chamber (1) for dividing the combustion chamber (1), in an expanded position of the combustion chamber, in a forechamber section (21) and at least one further chamber section (22), the separation plate (18) having a plurality of through-openings (38) for communicating the forechamber section (21) with the at least one further chamber section (22); a movable combustion chamber wall (14) arranged parallel to the separation plate (18) for limiting, together with the separation plate (18), the forechamber section; an ignition device (52) located in the forechamber (21); and collapse control means (19, 20, 33) for controlling movement of the separation plate (18) and the movable wall (14), after combustion of the gas mixture in the combustion chamber (1), so that first, the forechamber section (21) collapses and then, the at least one further chamber section (22) collapse, wherein the collapse control means (19, 20, 33) comprises means for preloading the movable wall (14) and the separation plate (18) relative to each other, and wherein the collapse control means (19, 20, 33) comprises a lug (19) secured on the separation plate (18) and extending through the movable wall (14), and wherein the preloading means comprises a compression spring (33) arranged between a free end of the lug (19) and the movable wall (14).

2. A portable, combustion-engined tool, comprising a collapsible combustion chamber (1); a movable separation plate (18) located in the combustion chamber (1) for dividing the combustion chamber (1), in an expanded position of the combustion chamber, in a forechamber section (21) and at least one further chamber section (22), the separation plate (18) having a plurality of through-openings (38) for communicating the forechamber section (21) with the at least one further chamber section (22); a movable combustion chamber wall (14) arranged parallel to the separation plate (18) for limiting, together with the separation plate (18), the forechamber section, an ignition device (52) located in the forechamber (21); and collapse control means (19, 20, 33) for controlling movement of the separation plate (18) and the movable wall (14), after combustion of the gas mixture in the combustion chamber (1), so that first, the forechamber section (21) collapses and then, the at least one further chamber section (22) collapses, wherein the collapse control means provide for adjusting friction between the movable wall and the separation plate and another wall (2) of the combustion chamber (1).

3. A portable, combustion-engined tool, comprising a collapsible combustion chamber (1); a movable separation plate (18) located in the combustion chamber (1) for dividing the combustion chamber (1), in an expanded position of the combustion chamber, in a forechamber section (21) and at least one further chamber section (22), the separation plate (18) having a plurality of through-openings (38) for communicating the forechamber section (21) with the at least one further chamber section (22); a movable combustion chamber wall (14) arranged parallel to the separation plate (18) for limiting, together with the separation plate (18), the forechamber section; a fixed bottom (3) for limiting, together with the separation plate (18), the at least one further chamber section (22); an ignition device (52) located in the expanded position of the combustion chamber, in the forechamber section (21); and collapse control means (19, 20, 33) for controlling movement of the separation plate (18) and the movable wall (14) in a direction toward the fixed bottom (33), after combustion of the gas mixture in the combustion chamber (1), so that first, the forechamber section (21) collapses and then, the at least one further chamber section (22) collapses.

4. A tool according to claim 3, wherein the through-openings (38) of the separation plate (18) are formed as check valves providing for gas flow only from the forechamber section (21) into the further chamber section (22).

5. A tool according to claim 1 wherein the movable wall (14) is provided with at least one check valve (36) for enabling flow of air into the forechamber section (21).

* * * * *